US009789028B2

(12) United States Patent
Leffler et al.

(10) Patent No.: US 9,789,028 B2
(45) Date of Patent: Oct. 17, 2017

(54) SPOON FOR ADMINISTERING A MEDICATION

(71) Applicant: Adam Leffler, Salt Lake City, UT (US)

(72) Inventors: Adam Leffler, Salt Lake City, UT (US); Zack Bybee, Draper, UT (US); Melinda Fox, Draper, UT (US)

(73) Assignee: Adam Leffler, Lake Elsinore, CA (US)

( * ) Notice: Subject to any disclaimer, the term of this patent is extended or adjusted under 35 U.S.C. 154(b) by 0 days.

(21) Appl. No.: 14/543,647

(22) Filed: Nov. 17, 2014

(65) Prior Publication Data

US 2015/0068047 A1 Mar. 12, 2015

Related U.S. Application Data

(63) Continuation-in-part of application No. 13/220,414, filed on Aug. 29, 2011, now Pat. No. 8,898,912.

(60) Provisional application No. 61/993,859, filed on May 15, 2014.

(51) Int. Cl.
*A61J 7/00* (2006.01)
*A47G 21/00* (2006.01)

(52) U.S. Cl.
CPC ..... *A61J 7/0023* (2013.01); *A47G 21/004* (2013.01)

(58) Field of Classification Search
CPC ..... A61J 7/0023
USPC ..... 30/141, 324–328, 125, 41, 41.5, 123.3, 30/162; 222/92, 93, 95; 426/115
See application file for complete search history.

(56) References Cited

U.S. PATENT DOCUMENTS 1,514,018 A * 11/1924 Sharpe ..... B65D 35/28 222/93
2,550,210 A * 4/1951 Vance, Jr. ..... A61J 9/00 30/123.3
2,698,996 A * 1/1955 Hickerson ..... A61J 7/0023 30/324
2,795,043 A * 6/1957 Fleischer ..... A61J 7/0023 30/141
3,116,152 A * 12/1963 Smith ..... A47G 21/004 30/141
3,289,893 A * 12/1966 Vance et al. ..... B65D 35/285 222/102
4,322,885 A * 4/1982 Osada ..... B26B 5/002 30/162
4,562,643 A * 1/1986 Cataudella ..... B26B 21/446 30/41
4,635,361 A * 1/1987 DeMars ..... B26B 21/446 30/41
4,653,188 A * 3/1987 Kwak ..... B26B 21/446 30/41
4,753,006 A * 6/1988 Howe ..... B26B 21/446 30/41
4,760,642 A * 8/1988 Kwak ..... A46B 11/0024 30/41
4,880,409 A * 11/1989 Bergkvist ..... A01K 9/005 D7/653
4,888,188 A * 12/1989 Castner, Sr. ..... A47G 19/183 30/141
5,038,974 A * 8/1991 DaCosta ..... B65D 83/0055 30/123.3

(Continued)

*Primary Examiner* — Jason Daniel Prone

(57) ABSTRACT

A spoon for administering a carrier medium includes a bowl and a handle. Various configurations of the bowl or handle can allow a carrier medium or medication to be more easily dispensed.

13 Claims, 27 Drawing Sheets

(56) References Cited

U.S. PATENT DOCUMENTS 5,137,183 A * 8/1992 Mikulec ..... A61J 7/0023 222/212
5,269,063 A * 12/1993 Okada ..... B26B 5/002 30/162
5,344,424 A * 9/1994 Roberts ..... A61B 17/3213 30/162
5,377,879 A * 1/1995 Isaacs ..... A61J 7/0023 222/192
5,462,101 A * 10/1995 Mouchmouchian .. A61J 7/0023 222/192
5,491,895 A * 2/1996 Lee ..... A47G 21/004 30/141
5,497,553 A * 3/1996 Chong ..... B26B 5/002 30/162
5,664,330 A * 9/1997 DeMars ..... B26B 21/446 30/41
D389,315 S * 1/1998 Travesi ..... D4/108
5,713,232 A * 2/1998 Hodge ..... A44B 15/005 30/169
6,006,433 A * 12/1999 Baltazar ..... B26B 5/001 30/152
6,101,721 A * 8/2000 Medhurst ..... B26B 1/08 30/125
6,279,233 B1 * 8/2001 Cameron ..... A61J 7/0046 30/125
6,347,727 B1 * 2/2002 Diaz ..... A61J 7/0023 30/141
6,675,482 B1 * 1/2004 Gilbert, Jr. ..... A61J 7/0023 30/141
7,210,600 B1 * 5/2007 Delio, Jr. ..... A47G 21/04 222/93
D589,760 S * 4/2009 Mozar ..... D7/643
7,975,386 B1 * 7/2011 Halvorson ..... A47J 43/28 30/141
8,607,459 B2 * 12/2013 Geissler ..... A47G 21/004 30/125
D701,355 S * 3/2014 Yamasaki ..... D30/132
8,898,912 B2 * 12/2014 Leffler ..... A61J 7/0023 30/326
8,905,668 B2 * 12/2014 Edmondson ..... A45D 34/04 222/101
9,107,524 B2 * 8/2015 Leffler ..... A61J 7/0023 30/123.3
2002/0148852 A1 * 10/2002 Schultz ..... A61J 7/0053 222/78
2010/0107415 A1 * 5/2010 Kurzet ..... B26B 21/446 30/41
2013/0090628 A1 * 4/2013 Ewing ..... A61J 7/0023 604/514

* cited by examiner

SPOON FOR ADMINISTERING A MEDICATION

CROSS-REFERENCE TO RELATED APPLICATIONS

This application is a continuation-in-part of U.S. patent application Ser. No. 13/220,414 which was filed on Aug. 29, 2011, now U.S. Pat. No. 8,898,912. This application also claims the benefit of U.S. Provisional Patent Application No. 61/993,859 which was filed on May 15, 2014.

BACKGROUND

In nursing homes, schools, prisons, hospitals, hospices and other skilled nursing facilities is often required to administer medicine to a patient who is either not able to self-administer or where it would be more beneficial to assure that the medicine be administered by a caregiver. In a typical environment the caregiver verifies the temperature of the medium such as applesauce; a spoon is dipped into the applesauce and a medicine is crushed into the applesauce and then administered to the patient. Problems with this technique are that the medium such as applesauce may become adulterated or cross contaminated as several spoons are dipped into the medium. The temperature can rise over time making the medium less desirable or dangerous if left in a warm environment for too long of a period. In addition, because the medication is ground and added to the carrier, if not all of the carrier medium is consumed, than a less than medically effective amount of medicine could be administered.

BRIEF SUMMARY

In some embodiments, the invention comprises a handle and a bowl which are designed to easily fit into the human mouth. Within the bowl is a medium such as a gel, a gelatin, a pudding, or natural foods such as applesauce. In some embodiments a medically effective amount of medicine has been premixed into the carrier medium before sealing the carrier medium in the bowl of the spoon. A protective seal than covers the top of the bowl and the entire device is pasteurized so that the device can then be packed in a sterile container and will remain sterile until administration. The spoon is constructed of food grade plastic to survive the pasteurization/sterilization process without any detrimental effects. In some embodiments, the handle is shaped with a groove so that a finger may be slid into the groove and under a portion of the film seal to assist in removal of the film seal from the top of the bowl. The top of the bowl of the spoon is designed to have smooth edges that will not damage the human mouth. The spoon can be constructed using a mold press. Once the spoons are molded from food grade plastic they are sanitized, filled with carrier medium and sealed. The entire filled and sealed spoon is then pasteurized and sterilized. They are then immediately packaged into a sanitarily lined container which is then sealed. In use, a caregiver grasps the spoon by the end of the handle and uses a second hand to slide a thumb or finger along a groove molded into the handle to assist in pulling the seal lip back away from the bowl of the spoon. Using the hand that has been holding the handle, the person can then either introduce an effective amount of medicine into the bowl or locate medicine within the handle of the device and place that into the bowl with the carrier and mix it therewith. Some embodiments have a detachable mixing extension which can be removed from the end of the spoon to mix the medicine with the carrier medium found in the bowl or the spoon. The bowl is shaped so that the final portion of the bowl which would enter a patient's mouth are shallower and tapered to fit more easily and comfortably into the human mouth.

In other embodiments, a spoon for administering a carrier medium can comprise a bowl and a handle attached to the bowl. The handle can have a hollow interior and include a hole forming an opening from the hollow interior to the bowl thereby allowing a carrier medium contained within the hollow interior to be expelled from the hollow interior into the bowl. In some embodiments, the spoon may include a cover that opens to provide access to the hollow interior. The cover may include a slot within which a sliding member slides. The sliding member can include a blade that extends into the hollow interior. The blade can be configured to provide a force against a package of carrier medium contained within the hollow interior to cause the carrier medium to be expelled into the bowl. In other embodiments, the spoon may include a plunger that inserts into the handle to force the carrier medium through the hole and into the bowl.

In other embodiments, a spoon for administering a carrier medium can include a bowl and a handle that extends proximally from the bowl. The handle can include a first folding region, a second folding region proximal to the first folding region, a receptacle area between the first and second folding regions, and a crushing area positioned proximal to the second folding region. When the handle is folded along the second folding region, the crushing area can insert into the receptacle area.

In other embodiments, a spoon for administering a carrier medium can include a bowl and a handle. In some embodiments, the bowl can include an opening into which a cup containing a carrier medium or medication can be placed. In some embodiments, the handle can be arched and the spoon can include a flat region positioned between the bowl and the handle. The flat region can be planar with a top surface of the bowl. In some embodiments, the bowl can be a primary bowl and the spoon can include a secondary bowl adjacent the primary bowl. In some embodiments, the bowl can be retractable from the handle. In some embodiments, the handle can include a channel within which a strip slides. The strip can include a number of compartments for storing medication.

BRIEF DESCRIPTION OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Figure 1:
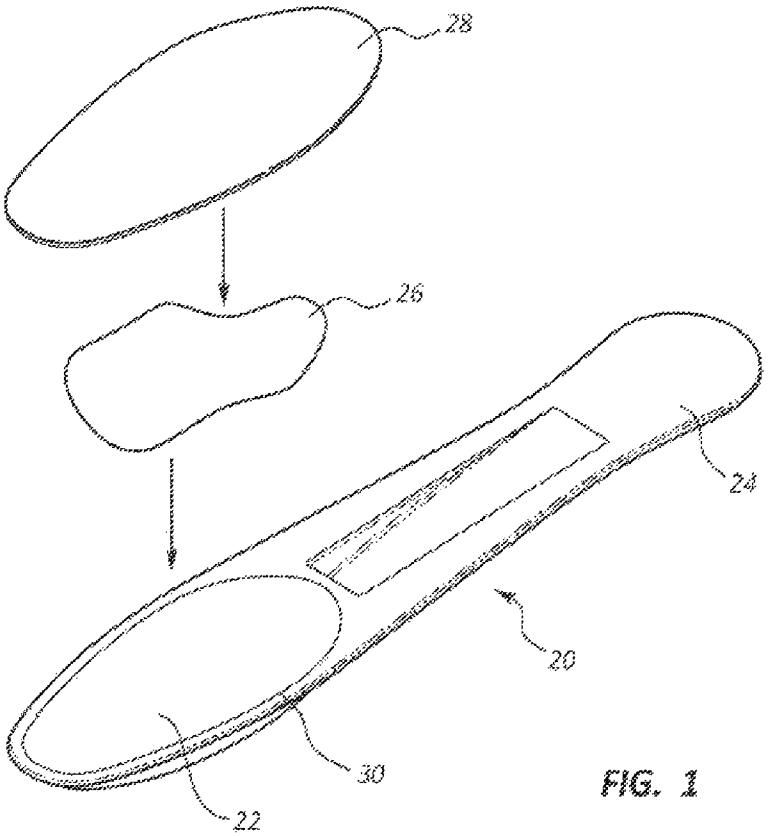
FIG. 1 shows a spoon delivery device having an indentation in the handle, a carrier medium and a seal.

Turning now to FIG. 1, a spoon-shaped medication delivery device or spoon 20 is shown having a bowl 22 and a handle 24. A carrier medium 26 can be a natural food such as applesauce or pudding or a gel or gelatin formulation. It may be desirable to create a carrier medium that is cohesive so it comes off the spoon in one piece to assure that all of the medication is consumed. Gel or gelatins may be required to avoid interaction of a natural food with the medication if stored for a long period of time. A seal 28 covers carrier medium 26 when placed into the bowl 22 and seals across a top or lip 30 of bowl 22.

Figure 2:
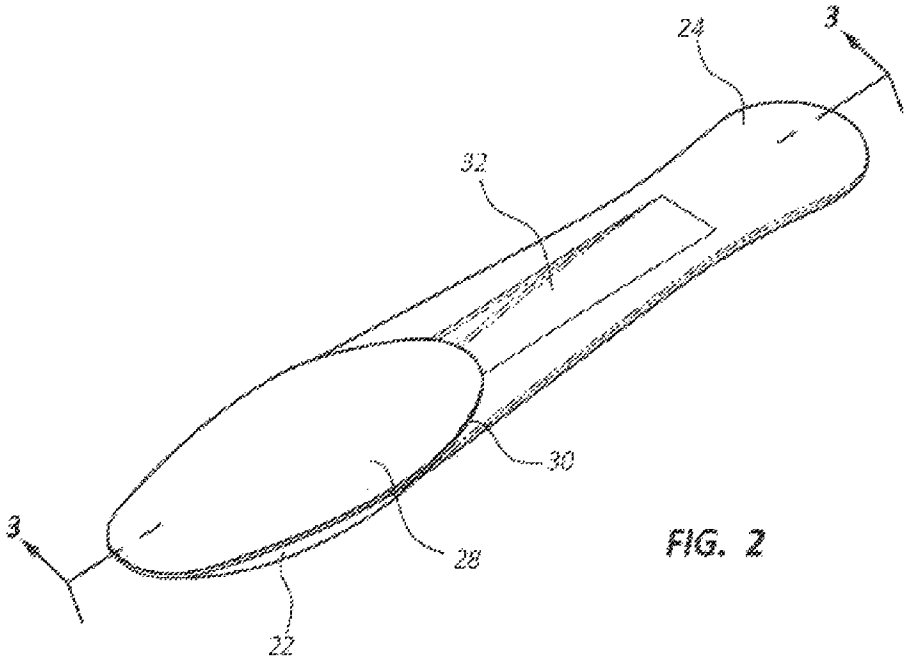
FIG. 2 shows an embodiment having a bowl in a sealed condition.

Turning now to FIG. 2, the device described in FIG. 1 is shown in its assembled condition. Seal 28 is now adhered to the top 30 of bowl 22 and covers a portion of a groove or indentation 32 formed in handle 24. Groove 32 allows a thumb or finger of a caregiver or user to be slid into the groove and under seal 28 to easily allow seal 28 to be peeled away from top 30 of bowl 22.

Figure 3:
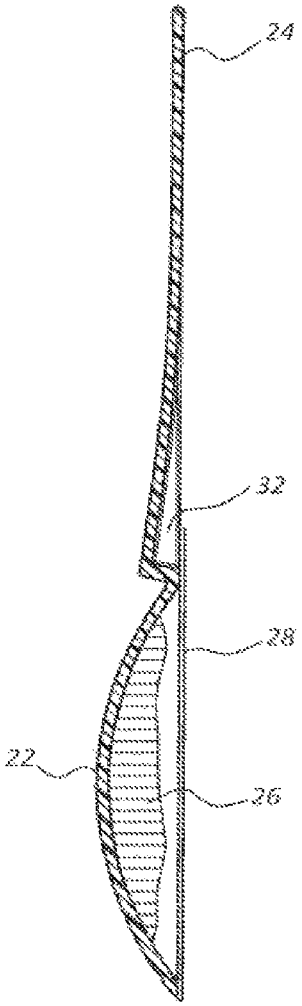
FIG. 3 is a cross sectional cut away view of the embodiment shown in FIG. 2 illustrating the seal on the bowl of the spoon with the carrier and medicine contained therein.
Figure 4:
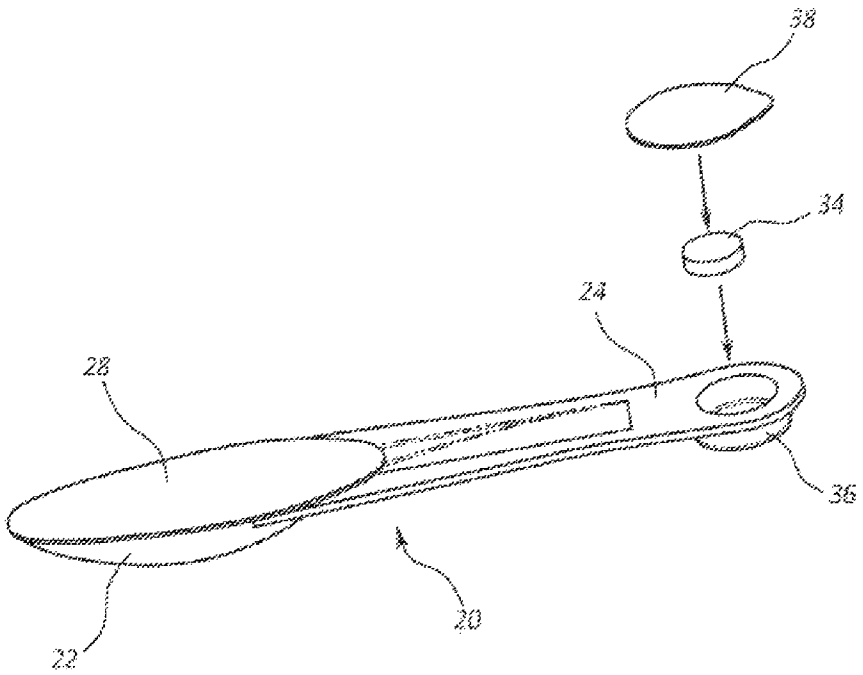
FIG. 4 is a perspective cut away view of an embodiment which contains a medication shown in a solid form which could also be a gel or a liquid stored within the handle. A medicine container in the handle of the spoon can be used so that the medicine can be kept in the handle of the spoon in cases where mixing the medicine with the carrier would shorten the shelf life or be undesirable for other reasons.
Figure 5:
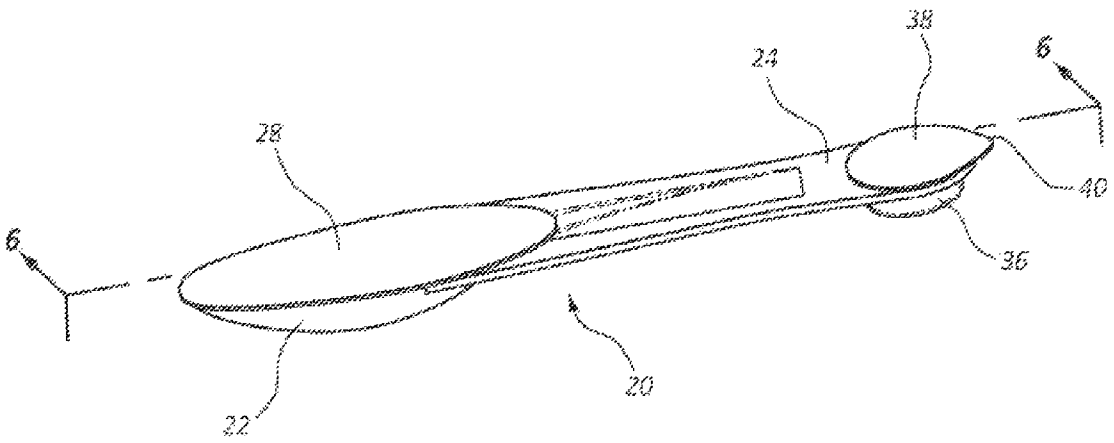
FIG. 5 shows the embodiment of FIG. 4 in a sealed condition.

FIG. 3 is a cross-sectional view of the embodiment shown in FIG. 2 showing the carrier medium 26 sealed within bowl 22 by seal 28. FIG. 4 shows an embodiment of the spoon or medicine delivery device showing a sealed bowl having only carrier medium 22. In this embodiment medicine or a medication 34 is shown stored in a well 36 formed in the handle 24. In this embodiment a well seal 38 seals medication 34 within well 36 so that the medication remains in a sterile condition. Just prior to use, in this embodiment seal 38 would be removed and medication 34 would be taken out of the handle 24 and broken or ground. Seal 28 would be removed from the bowl 22 and the ground medication would be mixed with the carrier medium 26 held in the bowl 22 and then would be administered to the patient. FIG. 5 shows the embodiment shown in FIG. 4 in its assembled form having both well seal 38 and the seal over the bowl 28 affixed to the spoon 20. A tab 40 can be seen extending beyond well 36 so that the user may grasp well seal 38 and easily remove the seal when access to medication 34 is required.

Figure 6:
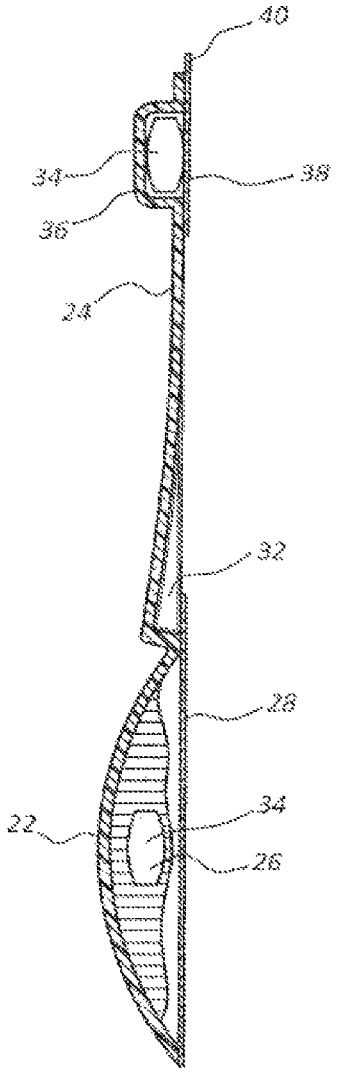
FIG. 6 shows a cross-section of the embodiment of FIG. 5 with a medicine stored both in the handle and in the bowl.
Figure 7:
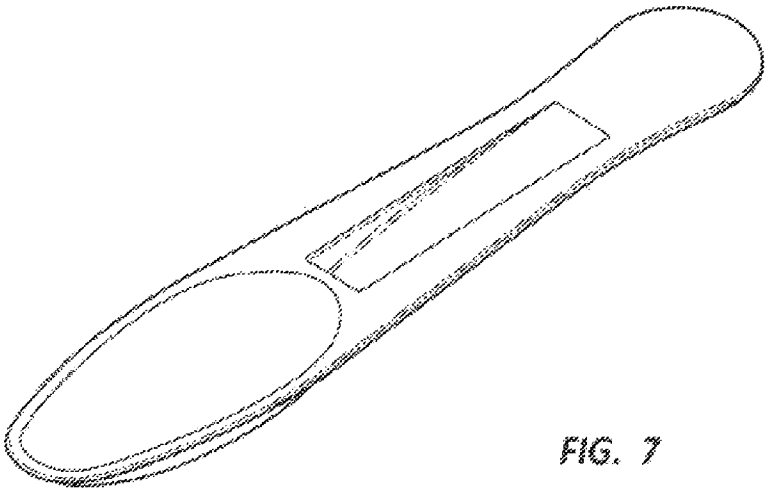
FIG. 7-12 show various embodiments of the spoon from different viewpoints.
Figure 8:
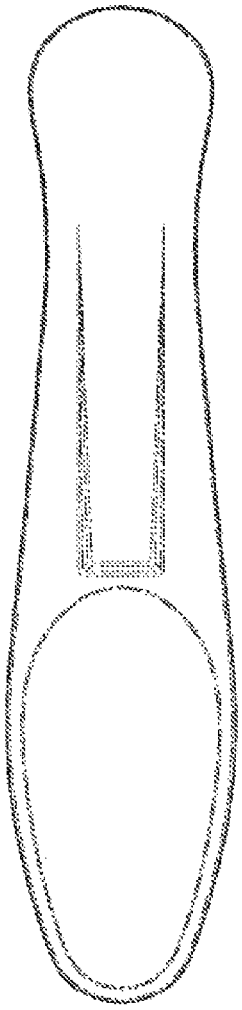
Figure 9:
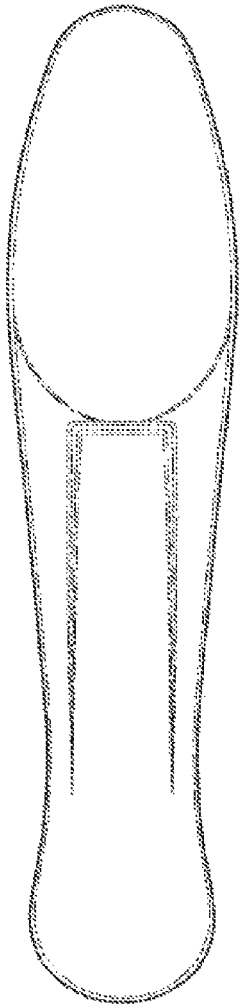
Figure 10:
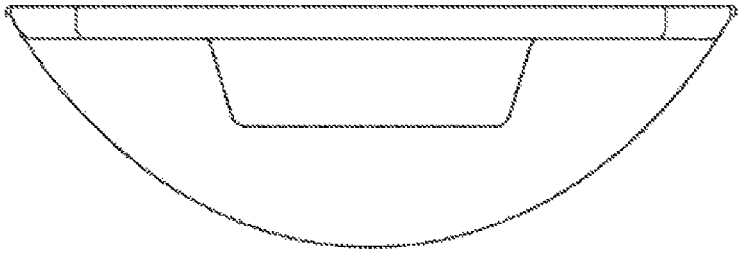
Figure 11:
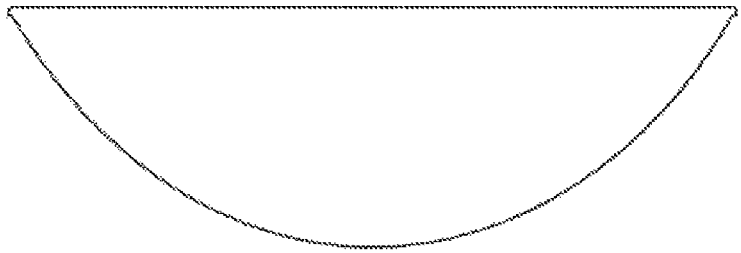
Figure 12:
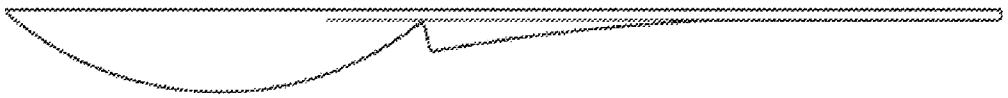

FIG. 6 is a cross-sectional view of an embodiment that has a well 36 located in handle 24 and a well seal 38 within which a medication may be stored. This embodiment also has within the carrier medium 26 a separate medication which can be easily stored without degradation with the carrier medium 26. In this embodiment, two medications can be administered at the same time even though those two medications may not store well when combined. By storing one medication in well 36 and the second medication premixed with the carrier medium 26 a variety of medications can be administered at the same time which might not be able to be stored in the same location.

Figure 13:
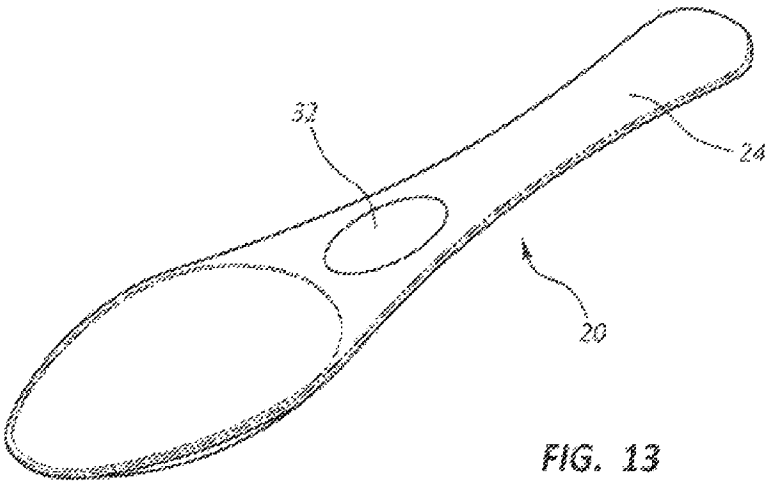
FIG. 13 shows an embodiment having an oral channel.

FIGS. 7 through 12 show an embodiment of the present invention from several viewpoints FIG. 13 shows an embodiment of the invention having a groove 32 which has a generally oval shape which may be preferable in some environments for production storage or for allowing easy release of seal 28.

Figure 14:
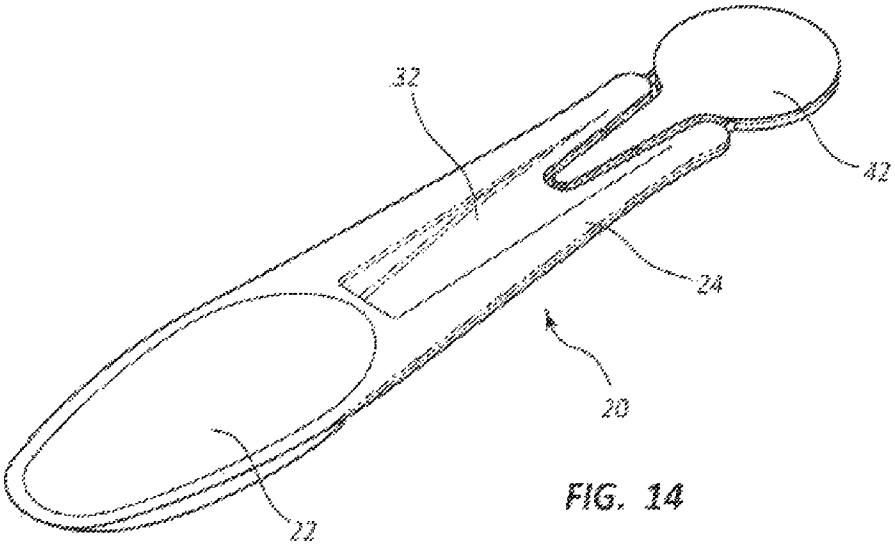
FIG. 14 shows an embodiment of the spoon having a breakaway stirring device located in the handle of the spoon.

FIG. 14 shows an embodiment having a bowl 22 and handle 24 with groove 32 but in this embodiment a mixing device 42 is attached to spoon 20.

Figure 15:
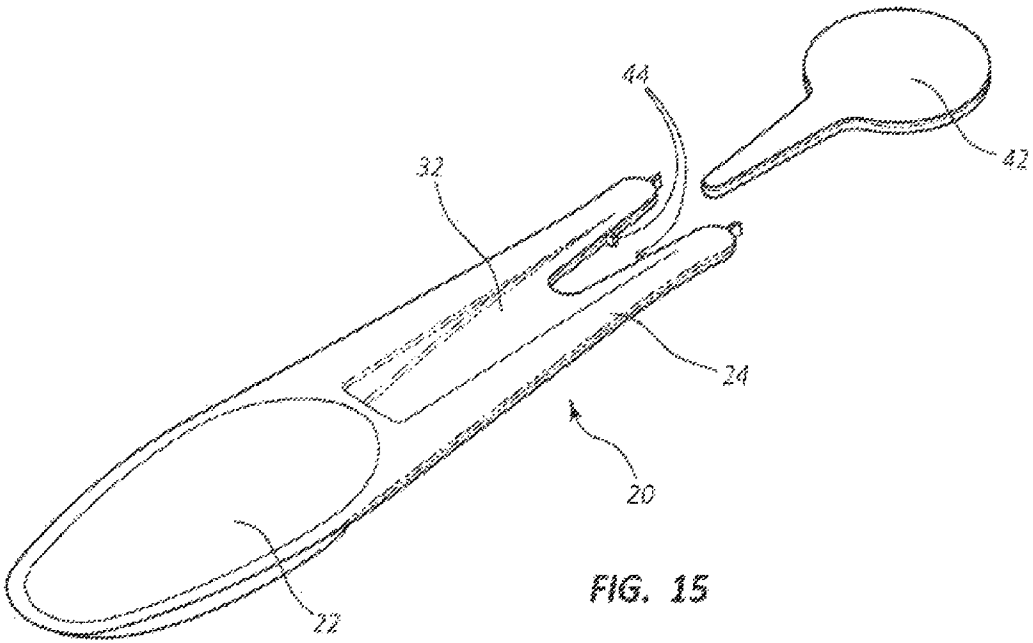
FIG. 15 shows the stirring device broken away from the handle of the spoon.

FIG. 15 shows mixing device 42 having been broken away from handle 24 where it was attached by attachment points 44. Mixing device 42 is used to combine medication with the carrier medium 26 in bowl 22 prior to administration to a patient.

Figure 16:
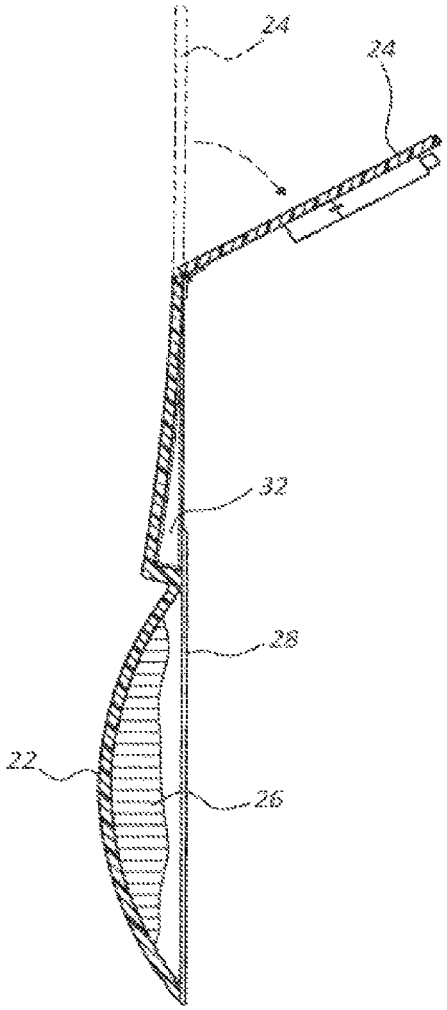
FIG. 16 shows an embodiment with a hinged handle.
Figure 17:
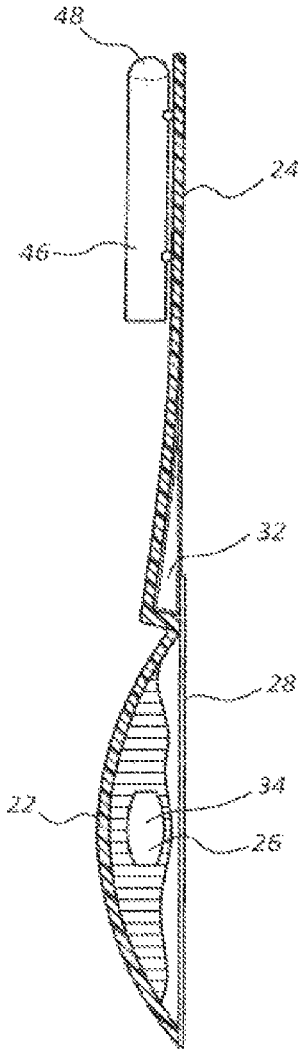
FIG. 17 depicts an embodiment wherein a squeeze tube is detachably joined to the handle.

FIG. 16 illustrates an embodiment that has a folding handle 24. FIG. 17 illustrates an embodiment that has a tube 46 formed as part of handle 24 and a cap 48 which is capable can be removed to allow access to the contents of tube 46. Tube 46 may either be detachable so that the contents of the tube can be added to the carrier medium 26 in bowl 22 and then stirred and administered, or in some embodiments with the folding handle 24, tube 46 is oriented so that its contents can be squirted directly into bowl 22 when in the folded position.

It will be appreciated by those skilled in the art that carrier medium 26 can be comprised of many different ingredients including traditional applesauce or other food items which can be sealed in bowl 22. However, carrier medium 26 can also be created of artificial ingredients forming a gel that provides for a long shelf life and may be sufficiently flavored so that the taste of some medications can be masked. Bowl 22, because of its more shallow shape, allows insertion of the spoon into the mouth of patients who cannot fully open their mouth. The tapered shape of the bowl allows for insertion of the spoon between the lips and parts the lips of a patient. Additionally, handle 24 is designed with a wide surface for a firm grip by caregivers as well as for allowing for groove 32 to form a channel in the handle guiding a user's thumb for easy removal of seal 28. In some embodiments, the carrier medium 26 has a slurry-like consistency and is preloaded with medication in those instances that will not deleteriously affect the shelf life. In most embodiments, the slurry has no lactose or glucose, and instead natural sweeteners such as stevia are used. In some of these formulas rice milk is used. Since the glue holding the seal 28 to the bowl 22 may also undergo pasteurization, food grade plastics and adhesives can be used so that when the entire sealed spoon undergoes a 200 degree hot bath and then is quickly cooled, the entire device will be sterile and is carefully handled so that it is not contaminated as it is being packed into sterile packaging. The medically effective spoon may then be removed and administered to a patient without concern for contamination. By sterilizing each spoon and administering it to one patient, the chance of cross contamination is eliminated. In some embodiments, no pasteurization is required.

A benefit of having a single serving spoon is that all of the contents are consumed by the patient and therefore all of the medication therein will be consumed. Many carrier mediums 26 because of their gel-like consistency slide out of bowl 22 in one piece and are therefore completely consumed as opposed to a more traditional medium such as applesauce wherein a patient may not consume the entire spoonful and may be require to have the spoon re-administered to completely empty the spoon.

Figure 18A:
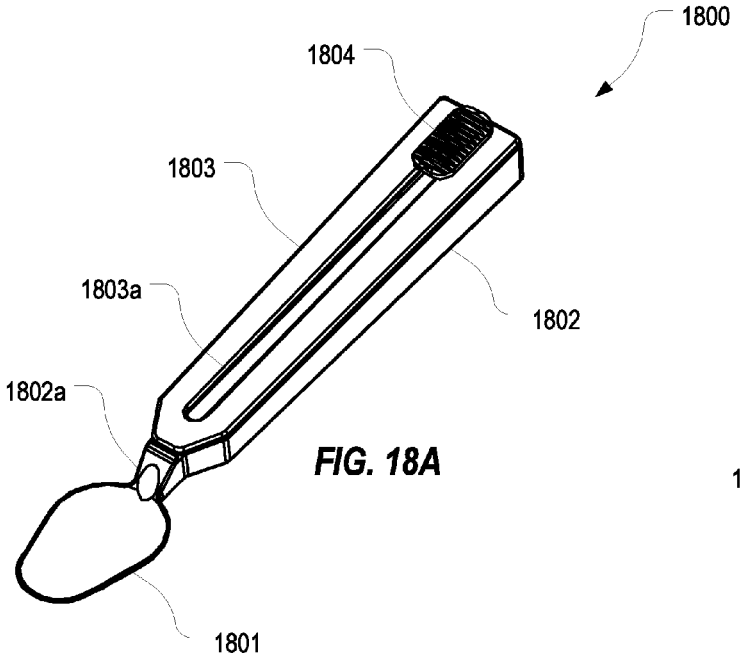
FIGS. 18A-18D illustrate a spoon having a hollow handle in which a packaged carrier medium can be placed.
Figure 18B:
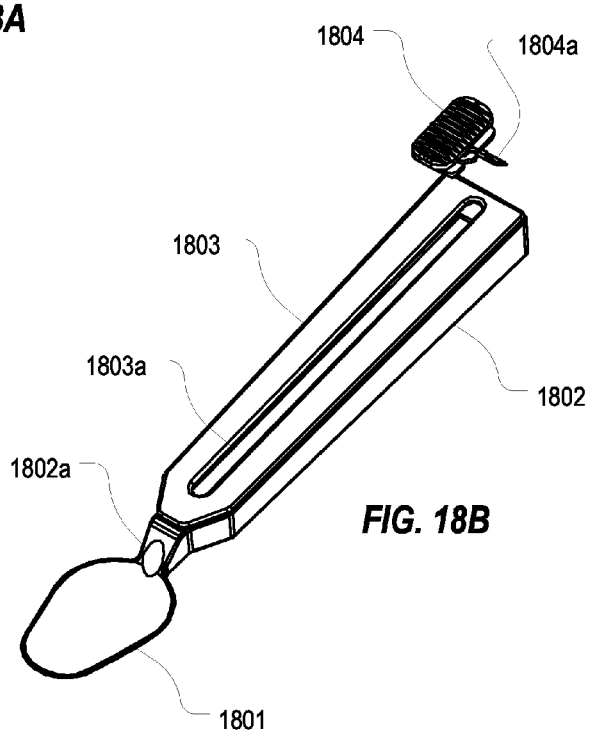
Figure 18C:
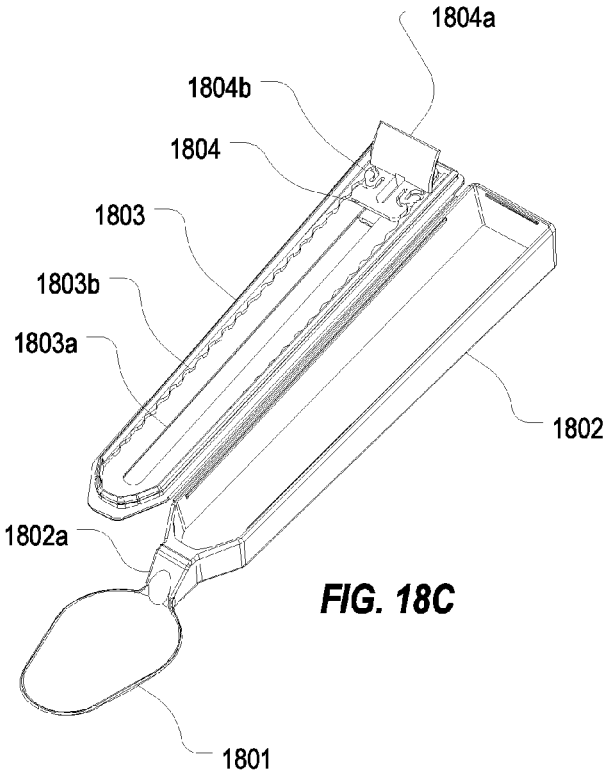
Figure 18D:
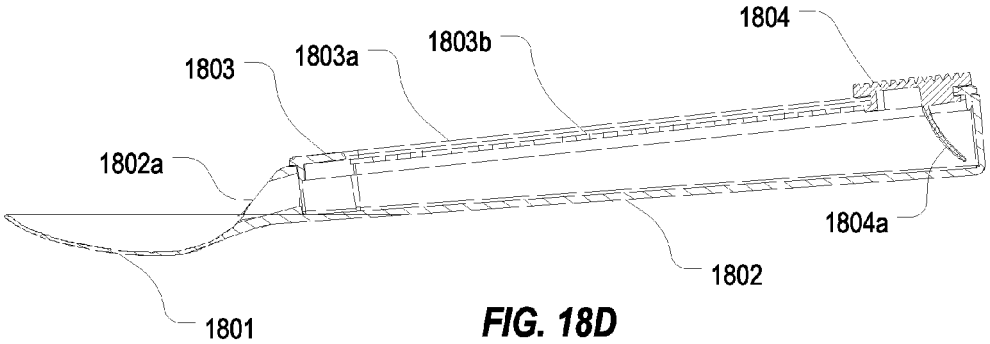

FIGS. 18A-18D illustrate a spoon 1800 having a hollow handle in which a packaged carrier medium can be placed. As shown, spoon 1800 includes a bowl 1801, a handle 1802 that is hollow and includes a hole 1802*a* forming an opening into bowl 1801, a cover 1803, and a sliding member 1804. As shown in FIG. 18C, cover 1803 opens to provide access to the hollow interior of handle 1802. Cover 1803 includes a longitudinal slot 1803*a* within which sliding member 1804 slides. As best shown in FIG. 18D, sliding member 1804 includes a blade 1804*a* which extends into the hollow interior of handle 1802. Initially, sliding member 1804 can be positioned as shown in FIGS. 18C and 18D to allow a package containing a carrier medium to be loaded into handle 1802. Hole 1802*a* can be configured to receive an end of the package and, in some embodiments, secure the end within the hole (e.g., via grooves, protrusions, etc.). Then, with cover 1803 closed and the package inside handle 1802, sliding member 1804 can be slid towards bowl 1801. As sliding member 1804 is slid, blade 1804*a* can apply a force to the carrier medium to cause it to be expelled from the package, through hole 1802*a*, and into bowl 1801 where it can be consumed. The carrier medium may include a medication in some embodiments. Alternatively, a medication may be placed in bowl 1801 before, while, or after the carrier medium is expelled into bowl 1801 where it can be mixed with the carrier medium. In some embodiments, the carrier medium may be directly placed (i.e., without packaging) inside the hollow interior of handle 1802. In such embodiments, longitudinal slot 1803*a* may be configured to form a seal to prevent the carrier medium from exiting the handle through the slot.

As shown in FIG. 18C, cover 1803 can include a series of ridges 1803*b* while sliding member 1804 can include compressible protrusions 1804*b* which insert between ridges 1803*b*. The interaction between protrusions 1804*b* and ridges 1803*b* can cause sliding member 1804 to slide in incremental distances along cover 1803 (e.g., by clicking). In some embodiments, cover 1803 can include one or more markings which each identify a quantity of the carrier medium that will be expelled into bowl 1801 when sliding member 1804 is slid to the marking. Each marking can correspond with a particular ridge 1803*b*. For example, if handle 1802 is sized to hold a package containing 100 mL of carrier medium, markings may be placed along cover 1803 in locations that correspond with the ridges into which protrusions 1804*b* would need to be positioned to cause a 25 mL, a 50 mL, a 75 mL, and a 100 mL dose to be dispensed into bowl 1801. Once a carrier medium is consumed, the package that contained the carrier medium can be removed from handle 1802 and a different package can be inserted to allow spoon 1800 to be reused.

Figure 19A:
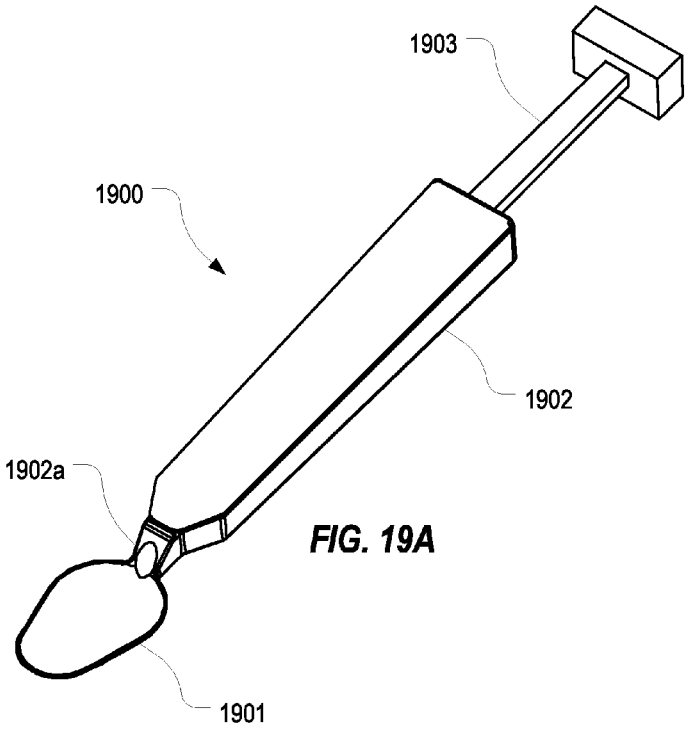
FIGS. 19A and 19B illustrate a spoon having a hollow handle with a plunger.
Figure 19B:
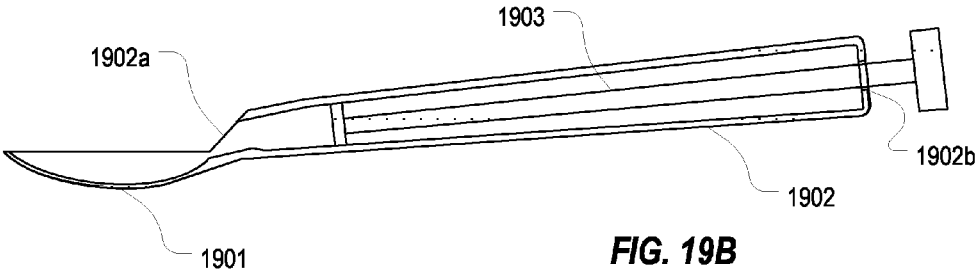

FIGS. 19A and 19B illustrate a spoon 1900 that also includes a hollow handle into which a carrier medium can be placed. Spoon 1900 includes a bowl 1901, a handle 1902 that is hollow and includes a hole 1902*a* that forms an opening into bowl 1901, and a plunger 1903. Plunger 1903 can be used in a similar manner as a syringe to cause the carrier medium to be expelled from handle 1902 into bowl 1901 through hole 1902*a*. Handle 1902 may be prefilled with a carrier medium in which case a seal may be placed over hole 1902*a* which can be pierced or separated when the carrier medium is to be dispensed.

In some embodiments, spoon 1900 can be configured to be reusable. For example, handle 1902 can include a cover (not shown, but may be similar to cover 1803) to allow a package containing the carrier medium to be placed within handle 1902. In other embodiments, handle 1902 can be configured to allow plunger 1903 to be removed from end 1902*b* thereby allowing the carrier medium to be injected into handle 1902 or a package containing the carrier medium to be inserted into handle 1902. Once the carrier medium is injected into handle 1902 or a package is inserted into handle 1902, plunger 1903 could then be reinserted through end 1902*b*. In embodiments where a packaged carrier medium is employed, hole 1902*a* can be configured to receive and possibly secure (e.g., via grooves, protrusions, etc.) an end of the package.

In some embodiments, plunger 1903 may include markings along its length which indicate how much carrier medium will be expelled into bowl 1901 when plunger 1903 is inserted into handle 1902 a certain distance. As with spoon 1800, the carrier medium placed in spoon 1900 may include a medication in some embodiments. Alternatively, a medication may be placed in bowl 1901 before, while, or after the carrier medium is expelled into bowl 1901 where it can be mixed with the carrier medium.

Figure 20:
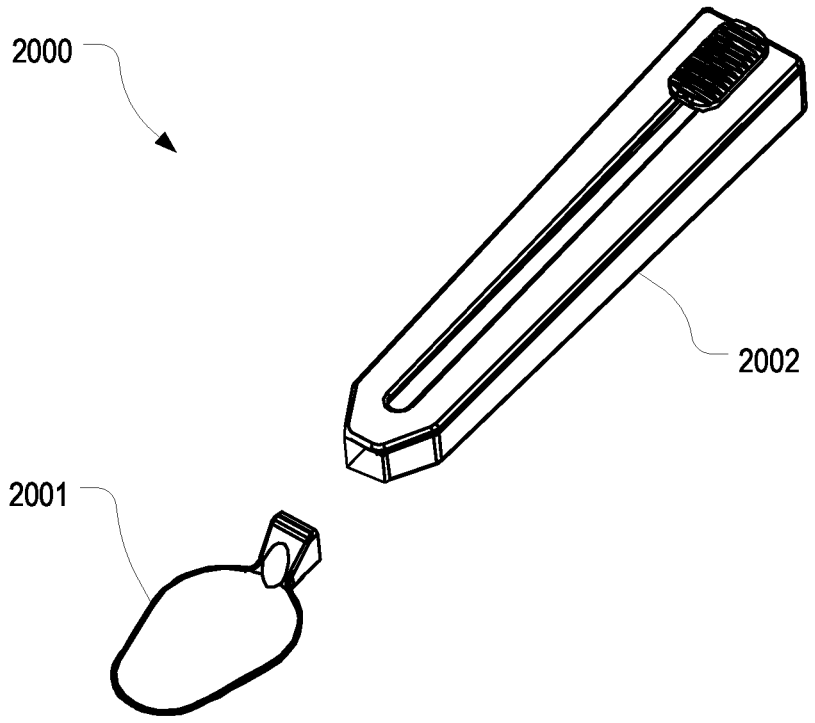
FIG. 20 illustrates a spoon having a removable bowl.

FIG. 20 illustrates a spoon 2000 that includes a bowl 2001 that is removable from handle 2002. Spoon 2000 is similar to spoon 1800; however, a removable bowl may be incorporated into any of the disclosed spoon designs. Bowl 2001 may be configured to attach to handle 2002 in various ways. For example, bowl 2001 and handle 2002 can be configured to allow bowl 2001 to snap into/onto handle 2002. In such embodiments, bowl 2001 can be removed from handle 2002 either by pulling the two components apart or by pressing a switch or latch on either handle 2002 or bowl 2001. Bowl 2001 and handle 2002 could also be configured with threads to allow bowl 2001 to be screwed onto handle 2002.

In any of the above described embodiments that employ a hollow handle to contain and dispense a carrier medium, the handle can be used without a bowl. For example, handles 1802 and 1902 could be used without bowls 1801 and 1901 respectively by ejecting the carrier medium through hole 1802*a*/1902*a* directly into the mouth of an individual.

Figure 21A:
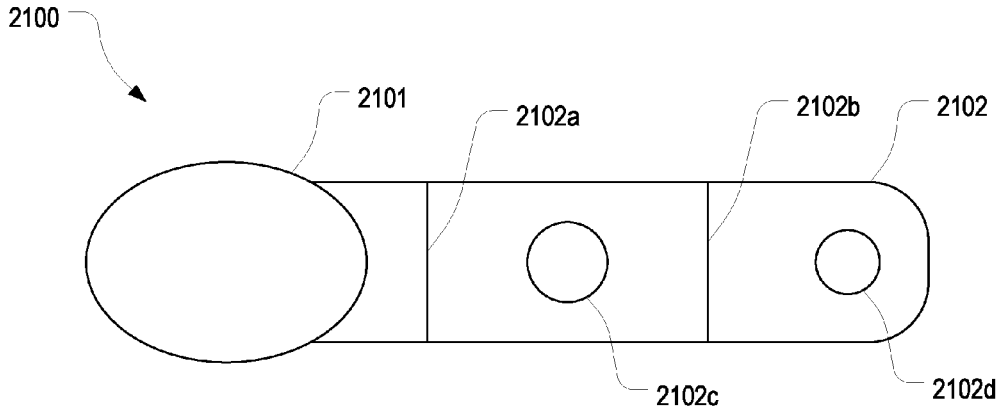
FIGS. 21A-21D illustrate a spoon having a foldable handle.
Figure 21B:
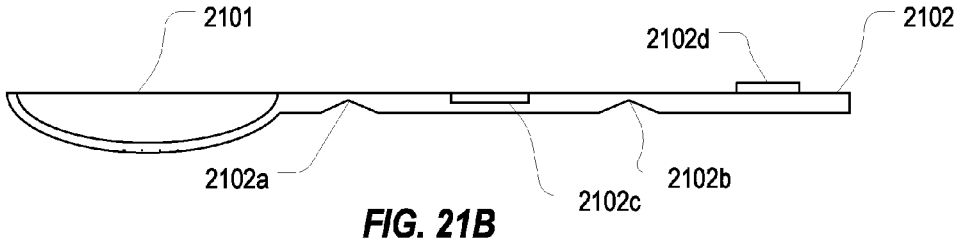
Figure 21C:
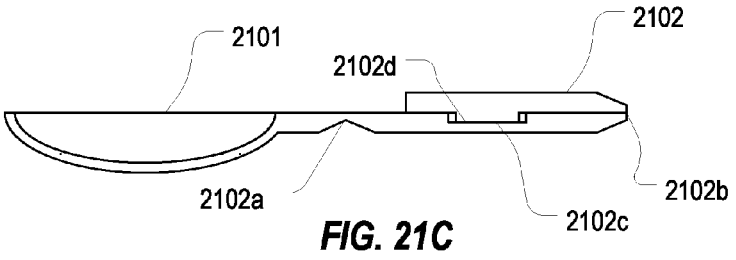
Figure 21D:
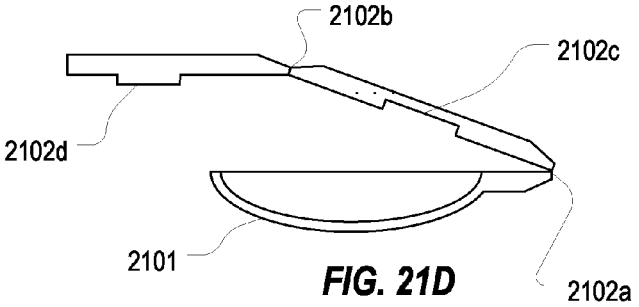

FIGS. 21A-21D illustrate a spoon 2100 that can be folded to crush a pill. As shown, spoon 2100 includes a bowl 2101 and a handle 2102. Handle 2102 includes two folding regions 2102*a*, 2102*b* which allow handle 2102 to be folded. Handle 2102 also includes a receptacle area 2102*c* and a crushing area 2102*d*. As shown in FIG. 21C, handle 2102 can be folded along folding region 2102*b* to cause crushing area 2102*d* to insert into receptacle area 2102*c* thereby crushing any pill contained in receptacle area 2102*c*. Then, as shown in FIG. 21D, handle 2102 can be folded along folding region 2102*a* to cause receptacle area 2102*c* to be positioned above bowl 2101 thereby causing any crushed pill to be dispensed into bowl 2101.

Figure 22A:
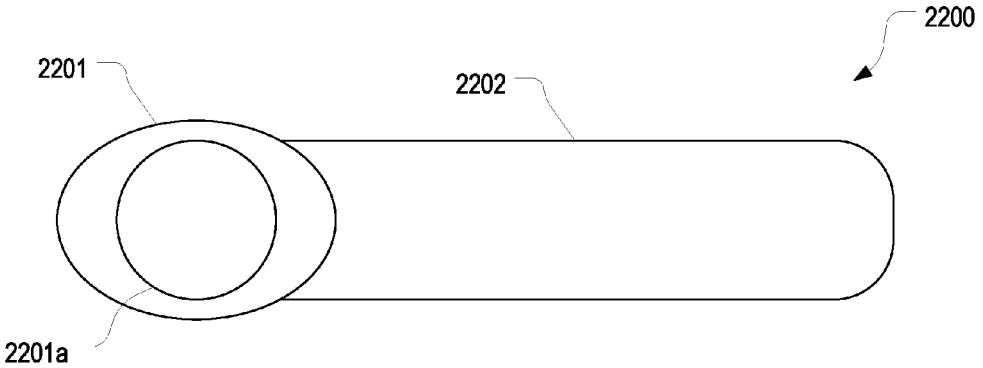
FIGS. 22A-22D illustrate a spoon having a bowl within which an opening is formed for holding a cup.
Figure 22B:
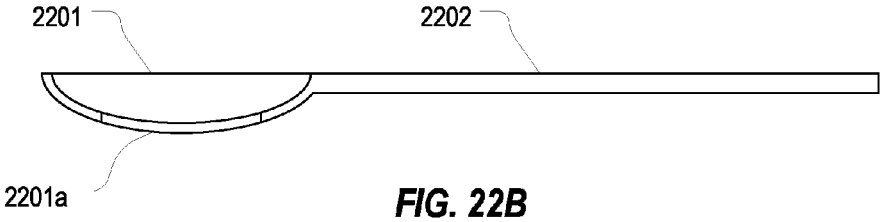
Figure 22C:
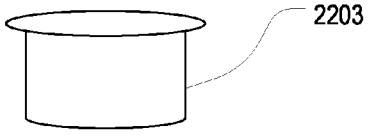
Figure 22D:
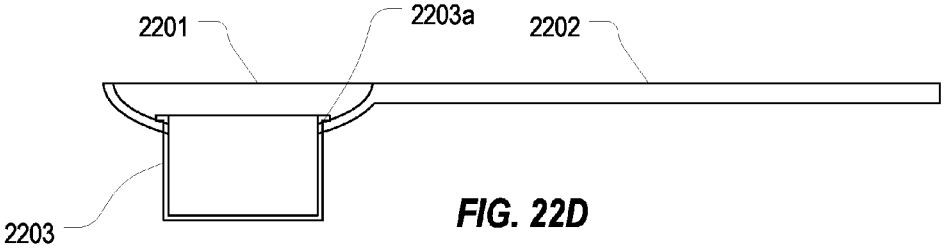

FIGS. 22A-22D illustrate a spoon 2200 having a handle 2202 and a bowl 2201 within which is formed an opening 2201*a*. Opening 2201*a* allows a cup 2203 to be placed within bowl 2201. Cup 2203 can include an upper surface 2203*a* having a diameter slightly larger than the diameter of opening 2201*a* so that upper surface 2203*a* rests on the surface of bowl 2201 thereby holding cup 2203 within bowl 2201 as shown in FIG. 22D. Cup 2203 can contain a carrier medium which can include a medication or which can be mixed with a medication that is separately added to bowl 2201. Once the carrier medium in cup 2203 is consumed, the cup can be discarded and spoon 2200 can be reused with another cup.

Figure 23A:
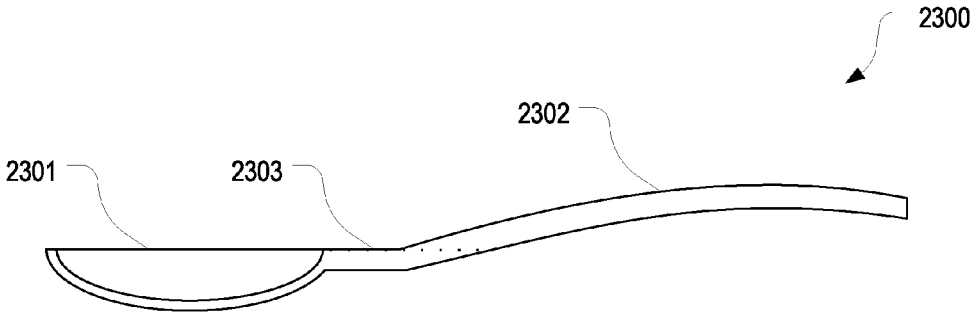
FIGS. 23A and 23B illustrate spoons having arched handles and a flat region to which a seal can be adhered.
Figure 23B:
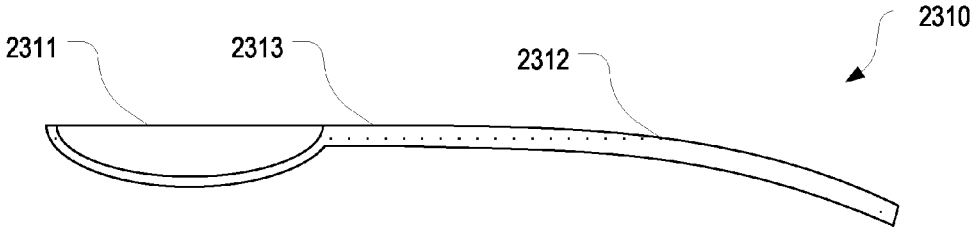

FIG. 23A illustrates a spoon 2300 having a bowl 2301, an arched handle 2302 that is angled upward, and a flat region 2303 between bowl 2301 and arched handle 2302. Flat region 2303 facilitates applying a seal overtop of bowl 2301 since flat region 2303 is planar with the top surface of bowl 2301. FIG. 23B illustrates a similar spoon 2310 having a bowl 2311, an arched handle 2312 that is angled downward, and a flat region 2313.

Figure 24A:
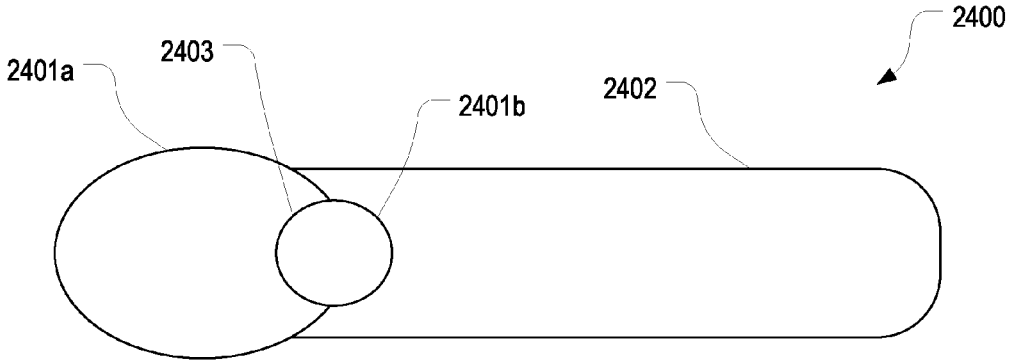
FIGS. 24A and 24B illustrate a spoon having multiple bowls.
Figure 24B:
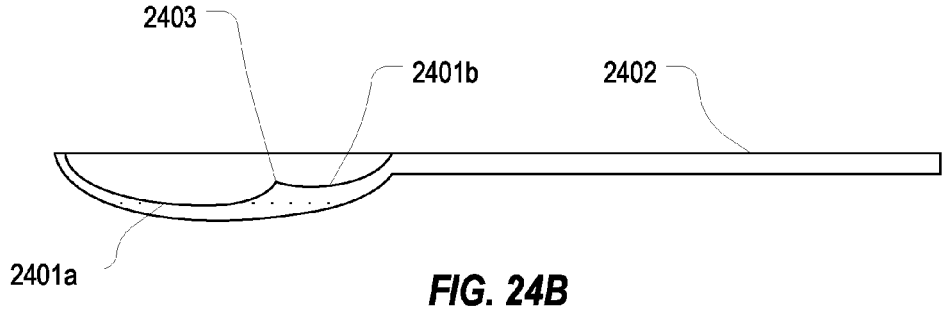

FIGS. 24A and 24B illustrate a spoon 2400 having multiple bowls. Spoon 2400 includes a primary bowl 2401*a*, a secondary bowl 2401*b*, and a handle 2402. Primary bowl 2401*a* and secondary bowl 2401*b* share an edge 2403, but primary bowl 2401*a* is deeper than secondary bowl 2401*b*. Edge 2403 can be lower than a top surface of primary bowl 2401*a* as is shown in FIG. 24B. Alternatively, edge 2403 can be at the same level as the top surface of primary bowl 2401*a*. In some embodiments, a carrier medium can be placed in primary bowl 2401*a* and a medication can be placed in secondary bowl 2401*b*. The medication can then be gradually transferred from secondary bowl 2401*b* into primary 2401*a* for mixing with the carrier medium. This can reduce the amount of spillage that may occur during mixing.

Figure 25A:
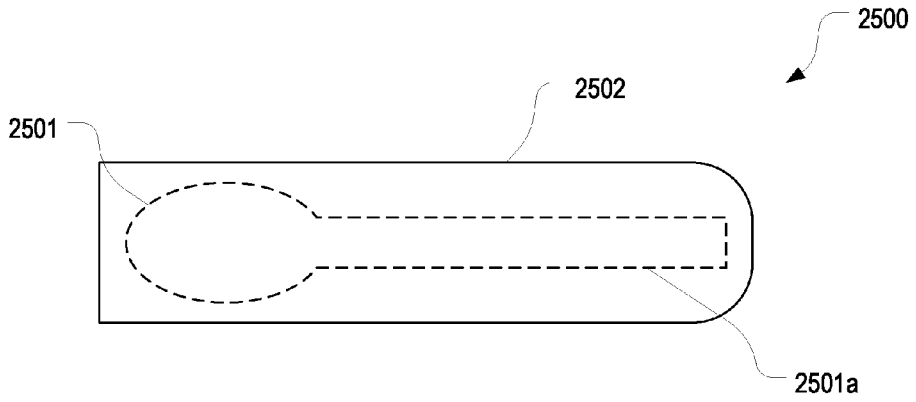
FIGS. 25A and 25B illustrate a spoon having a sliding bowl.
Figure 25B:
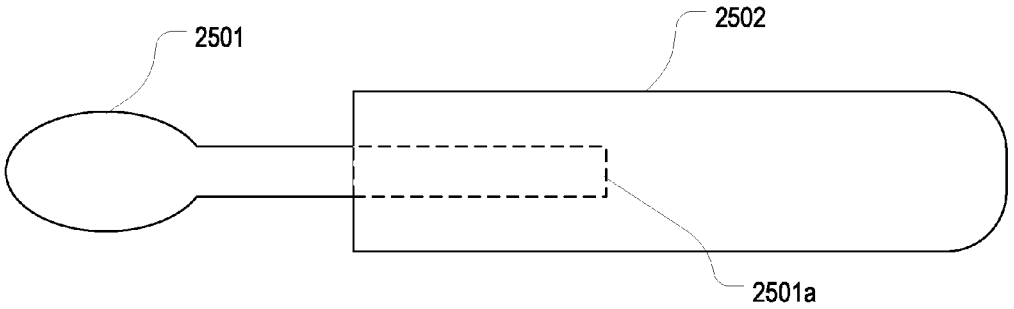

FIGS. 25A and 25B illustrate a spoon 2500 having a sliding bowl. Spoon 2500 includes a bowl 2501 having an extension 2501*a* and a handle 2502 into which bowl 2501 retracts. FIG. 25A shows bowl 2501 in a retracted position while FIG. 25B shows bowl 2501 in an extended position. In some embodiments, extension 2501*a* can be configured to prevent bowl 2501 from being separated from handle 2502. In other embodiments, extension 2501*a* can be configured to allow bowl 2501 to be removed from handle 2502 so that a new bowl can be inserted into handle 2502. Bowl 2501, in some embodiments, can contain a carrier medium and/or medication over which a seal is placed.

Figure 26A:
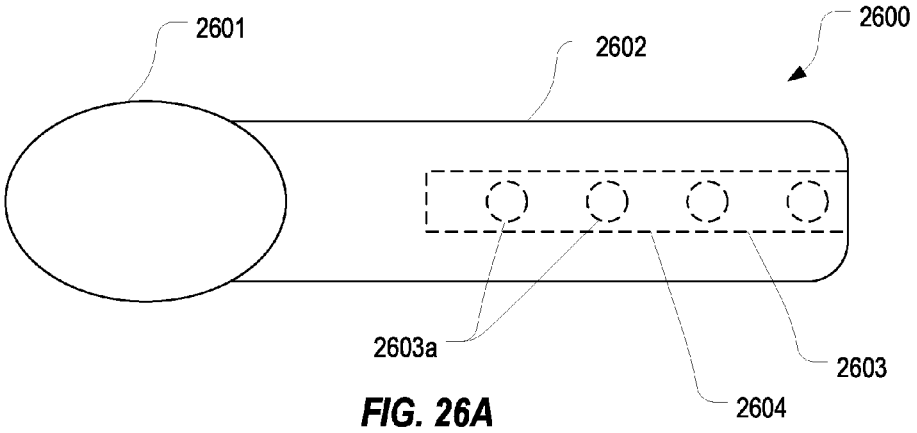
FIGS. 26A and 26B illustrate a spoon that includes a number of compartments for storing medication.
Figure 26B:
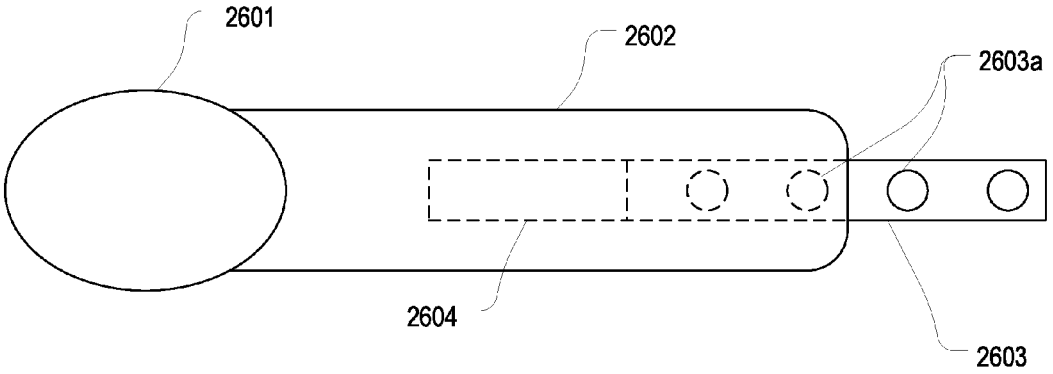

FIGS. 26A and 26B illustrate a spoon 2600 that includes a number of compartments for storing medication (e.g., pills). Spoon 2600 includes a bowl 2601 and a handle 2602. Handle 2602 includes a channel 2604 in which a strip 2603 is contained. Strip 2603 includes a number of compartments 2603*a* for storing medication such as pills. Strip 2603 can be slid out from channel 2604 to provide access to compartments 2603*a* as needed. Although FIGS. 26A and 26B illustrate channel 2604 as being formed on a bottom side of or inside handle 2602, channel 2604 could also be formed on a top side of handle 2602. Strip 2603 can have a sufficient thickness to allow compartments 2603*a* to be appropriately sized to contain pills or other medications. In embodiments where channel 2604 is formed on a surface of handle 2602, compartments 2603*a* can be configured to protrude out from the surface of the handle.

In some embodiments, a bowl of a spoon may be formed of an edible material to allow a patient to consume the bowl along with any carrier medium or medication that the bowl may contain. In any of the above described embodiments, the carrier medium can be a nutritional or non-nutritional item in the form of a liquid, powder, pudding, or gel. The carrier medium may, in some embodiments, also include a medication. Also, in any of the above described embodiments, the bowl may be prefilled with a medication or carrier medium and sealed. For example, spoons 1800, 1900, and 2000 could have their bowls prefilled with a medication that can be mixed with a carrier medium that is injected from the handles. Also, spoons 2100, 2300, 2400, 2500, and 2600 could have their bowls prefilled with a carrier medium and/or medication and sealed.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed:

1. A spoon for administering a carrier medium comprising:

a bowl;

a handle having a distal end attached to the bowl and a proximal end, thereby defining a proximal direction along the handle and away from the bowl, the handle also having a top side, a bottom side, a left side, and a right side that extend between the proximal and distal ends to form a hollow interior, the distal end of the handle including a hole forming an opening from the hollow interior to the bowl, wherein the top side of the handle forms a pivoting connection to one of the left side or right side of the handle such that the top side can be pivoted from a closed position in which the hollow interior is enclosed into an open position in which the hollow interior is exposed, the top side having a slot; and a sliding member that slides within the slot, the sliding member including a blade that extends into the hollow interior away from the slot and in the proximal direction, the blade configured to provide a force against a package of carrier medium contained within the hollow interior to cause the carrier medium to be expelled into the bowl through the opening;

wherein when the top side is pivoted from the closed position to the open position, the blade of the sliding member is removed from the hollow interior to facilitate insertion of a package of carrier medium.

2. The spoon of claim 1, wherein the top side includes a series of ridges and the sliding member includes one or more compressible protrusions that insert between the ridges to cause the sliding member to slide in incremental distances.

3. The spoon of claim 1, wherein:

the top side comprises an exterior surface and an interior surface, the interior surface comprising a series of ridges extending toward and away from the slot on either side of the slot; and the sliding member comprises one or more compressible protrusions that insert between the ridges to cause the sliding member to slide in incremental distances.

4. The spoon of claim 3, wherein the series of ridges comprise a first and second set of ridges, the first set of ridges formed adjacent a first side of the slot and extending toward the slot and toward a second set of ridges adjacent a second side of the slot, and the second set of ridges being formed adjacent the second side of the slot and extending toward the first set of ridges adjacent the first side of the slot, and wherein the one or more compressible protrusions comprise a pair of compressible protrusions outwardly directed toward the sets of ridges.

5. The spoon of claim 4, wherein the first and second sets of ridges are co-planar, whereby a distance between the first set of ridges and the second set of ridges varies with peaks and valleys of the ridges.

6. The spoon of claim 5, wherein the ridges are formed on a rim extending along an outer edge of the interior surface of the top side.

7. A spoon for administering a carrier medium comprising:

a bowl;

a handle having a distal end attached to the bowl and a proximal end, thereby defining a proximal direction along the handle and away from the bowl, the handle also having a top side, a bottom side, a left side, and a right side that extend between the proximal and distal ends to form a hollow interior, the distal end of the handle including a hole forming an opening from the hollow interior to the bowl, wherein the top side of the handle forms a pivoting connection to one of the left side or right side of the handle such that the top side can be pivoted from a closed position in which the hollow interior is enclosed into an open position in which the hollow interior is exposed, the top side comprising:

a slot;

an inward surface; and a series of ridges on the inward surface adjacent the slot and oriented toward the slot; and a sliding member that slides within the slot, the sliding member comprising:

a blade that extends into the hollow interior, the blade configured to provide a force against a package of carrier medium contained within the hollow interior to cause the carrier medium to be expelled into the bowl through the opening; and one or more compressible protrusions that insert between the ridges of the top side to cause the sliding member to slide in incremental distances;

wherein when the top side is pivoted from the closed position to the open position, the blade of the sliding member is removed from the hollow interior to facilitate insertion of a package of carrier medium.

8. The spoon of claim 7, wherein the series of ridges comprise a first and second set of ridges, the first set of ridges formed adjacent a first side of the slot and extending toward the slot and toward a second set of ridges adjacent a second side of the slot, and the second set of ridges being formed adjacent the second side of the slot and extending toward the first set of ridges adjacent the first side of the slot, and wherein the one or more compressible protrusions comprise a pair of compressible protrusions outwardly directed toward the sets of ridges.

9. The spoon of claim 8, wherein the first and second sets of ridges are co-planar, whereby a distance between the first set of ridges and the second set of ridges varies with peaks and valleys of the ridges.

10. The spoon of claim 9, wherein the ridges are formed on a rim extending along an outer edge of the inward surface of the top side.

11. The spoon of claim 7, wherein the sliding member extends through the slot and the blade extends away from the slot into the hollow interior at an angle in the proximal direction.

12. A spoon for administering a carrier medium comprising:

a bowl;

a handle having a distal end attached to the bowl and a proximal end, the handle also having a top side, a bottom side, a left side, and a right side that extend between the proximal and distal ends to form a hollow interior, the distal end of the handle including a hole forming an opening from the hollow interior to the bowl, wherein the top side of the handle forms a pivoting connection to one of the left side or right side of the handle such that the top side can be pivoted from a closed position in which the hollow interior is enclosed into an open position in which the hollow interior is exposed, the top side comprising:

a slot;

an inward surface;

a circumferential protrusion extending from the inward surface around the circumference of the inward surface; and two sets of ridges, each formed with and extending from opposite sides of the circumferential protrusion toward the slot; and a sliding member that slides within the slot, the sliding member comprising:

a blade that extends into the hollow interior, the blade configured to provide a force against a package of carrier medium contained within the hollow interior to cause the carrier medium to be expelled into the bowl through the opening; and one or more compressible protrusions that insert between the ridges of the top side to cause the sliding member to slide in incremental distances;

wherein when the top side is pivoted from the closed position to the open position, the blade of the sliding member is removed from the hollow interior to facilitate insertion of a package of carrier medium.

13. The spoon of claim 9, wherein the one or more compressible protrusions comprise two compressible protrusions, each of the protrusions being outwardly directed toward a respective one of the sets of ridges.

* * * * *